US006672264B2

(12) United States Patent
Watanabe et al.

(10) Patent No.: US 6,672,264 B2
(45) Date of Patent: Jan. 6, 2004

(54) VALVE TIMING CONTROL DEVICE OF INTERNAL COMBUSTION ENGINE

(75) Inventors: Masahiko Watanabe, Yokohama (JP); Tamotsu Todo, Kanagawa (JP)

(73) Assignee: Hitachi Unisia Automotive, Ltd., Atsugi (JP)

( * ) Notice: Subject to any disclaimer, the term of this patent is extended or adjusted under 35 U.S.C. 154(b) by 0 days.

(21) Appl. No.: 10/267,776

(22) Filed: Oct. 10, 2002

(65) Prior Publication Data

US 2003/0070641 A1 Apr. 17, 2003

(30) Foreign Application Priority Data

Oct. 12, 2001 (JP) ..... 2001-315062
Oct. 17, 2001 (JP) ..... 2001-319908

(51) Int. Cl.[7] ..... F01L 1/34

(52) U.S. Cl. ..... 123/90.17; 123/90.15; 123/90.17; 123/90.31

(58) Field of Search ..... 123/90.17, 90.15, 123/90.31

(56) References Cited

FOREIGN PATENT DOCUMENTS

JP 2001-41013 A 2/2001

OTHER PUBLICATIONS

U.S. patent application Ser. No. 10/267,864, Todo et al., filed Oct. 10, 2002.

U.S. patent application Ser. No. 10/267,866, Watanabe et al., filed Oct. 10, 2002.

U.S. patent application Ser. No. 10/267,678, Hibi et al., Oct. 10, 2002.

*Primary Examiner*—Thomas Denion
*Assistant Examiner*—Zelalem Eshete
(74) *Attorney, Agent, or Firm*—Foley & Lardner

(57) ABSTRACT

A first stopper device is arranged between an output element of a planetary gear unit and a drive rotation member driven by an output shaft of an engine. The first stopper device stops a relative rotation therebetween when a relative rotation angle therebetween comes to a first predetermined degree. A second stopper device may be arranged between a free element of the planetary gear unit and an input element of the planetary gear unit. The second stopper device stops a relative rotation therebetween when a relative rotation angle therebetween comes to a second predetermined degree.

20 Claims, 12 Drawing Sheets

VALVE TIMING CONTROL DEVICE OF INTERNAL COMBUSTION ENGINE

BACKGROUND OF INVENTION

1. Field of Invention

The present invention relates in general to valve timing control devices of internal combustion engines, and more particularly, to the valve timing control devices of a type that controls the operation timing of intake or exhaust valves of the engine in accordance with operation condition of the engine.

2. Description of Related Art

Hitherto, various types of valve timing control devices of internal combustion engine have been proposed and put into practical use particularly in the field of wheeled motor vehicles. Some of them are disclosed in Laid Open Japanese Patent Application (Tokkai) 2001-41013 and Japanese Patent Application 2001-24079. However, due to their inherent construction, the devices of such publications have failed to exhibit a satisfied performance in certain fields, That is, some are poor in saving energy, some are poor in durability and some are poor in suppressing noises.

SUMMARY OF INVENTION

It is therefore an object of the present invention to provide a valve timing control device of internal combustion engine, which is free of the above-mentioned drawbacks.

According to a first aspect of the present invention, there is a valve timing control device of an internal combustion engine, which comprises a drive rotation member adapted to be rotated by an output shaft of the engine; a driven rotation member coaxial with the drive rotation member, the driven rotation member rotating with a cam shaft of the engine to actuate engine operation valves; a relative angle controlling mechanism that controls a relative angle between the drive and driven rotation members; and an actuating device that actuates the relative angle controlling mechanism, the actuating device having a planetary gear unit which comprises a sun gear, a ring gear, a carrier plate and planetary gears rotatably held by the carrier plate and meshed with both the sun gear and the ring gear, the sun gear, the ring gear and the carrier plate serving as one of input, output and free elements, the input element being connectable to and driven by a rotation system that extends from the output shaft of the engine to the cam shaft of the engine, the output element being connectable to a rotation actuation element of the relative angle controlling mechanism in a manner to be controlled in rotation speed upon receiving an input force from the output shaft of the engine; and a first stopper device arranged between the output element and the drive rotation member, the first stopper device stopping a relative rotation therebetween when the relative rotation angle therebetween comes to a first predetermined degree.

According to a second aspect of the present invention, there is provided a valve timing control device of an internal combustion engine, which comprises a drive rotation member adapted to be rotated by an output shaft of the engine; a driven rotation member coaxial with the drive rotation member, the driven rotation member rotating with a cam shaft of the engine to actuate engine operation valves; a relative angle controlling mechanism that controls a relative angle between the drive and driven rotation members; and an actuating device that actuates the relative angle controlling mechanism, the actuating device having a planetary gear unit which comprises a sun gear, a ring gear, a carrier plate and planetary gears rotatably held by the carrier plate and meshed with both the sun gear and the ring gear, the sun gear, the ring gear and the carrier plate serving as one of input, output and free elements, the input element being connectable to and driven by a rotation system that extends from the output shaft of the engine to the cam shaft of the engine, the output element being connectable to a rotation actuation element of the relative angle controlling mechanism in a manner to be controlled in rotation speed upon receiving an input force from the output shaft of the engine; a first stopper device arranged between the output element and the drive rotation member, the first stopper device stopping a relative rotation therebetween when the relative rotation angle therebetween comes to a first predetermined degree, and a second stopper device arranged between the free element and the input element, the second stopper device stopping a relative rotation therebetween when the relative rotation angle therebetween comes to a second predetermined degree.

According to a third aspect of the present invention, there is provided a valve timing control device of an internal combustion engine, which comprises a drive rotation member adapted to be rotated by an output shaft of the engine; a driven rotation member coaxial with the drive rotation member, the driven rotation member rotating with a cam shaft of the engine to actuate engine operation valves; radially extending guide grooves formed in one surface of the drive rotation member; a circular guide plate arranged to rotate relative to the drive and driven rotation members, the circular guide plate being formed with a spiral guide groove at one surface thereof that faces the radially extending guide grooves; guided members each being slidably guided by both the spiral guide groove and one of the radially extending guide grooves; link arms each having one end pivotally connected to the driven rotation member and the other end to which corresponding one of the guided members is connected; an actuating device that actuates the circular guide plate to rotate relative to the drive and driven rotation members; a stopper device that restricts a rotation of the circular guide plate relative to the drive and driven rotation members, wherein when, upon operation of the actuating device, the circular guide plate is rotated relative to the drive and driven operation members, each of the guide members is forced to slide in both the spiral guide groove and the corresponding one of the radially extending guide grooves to induce a relative rotation between the drive and driven rotation members; and wherein the stopper device comprises a first member that is provided by the circular guide plate and a second member that is provided by the drive rotation member, the first and second members contacting with each other to stop the relative rotation between the circular guide plate and said drive rotation member when a relative rotation angle therebetween comes to a predetermined degree.

Other objects and advantages of the present invention will become apparent from the following description when taken in conjunction with the accompanying drawings.

DETAILED DESCRIPTION OF EMBODIMENTS

In the following, embodiments of the present invention, which are valve timing control devices 100 and 200, will be described in detail with reference to the accompanying drawings.

For ease of description, various directional terms, such as, right, left, upper, lower, rightward and the like are used in the following description. However, such terms are to be understood with respect to a drawing or drawings on which the corresponding part or portion is illustrated.

Furthermore, the following description is directed to a case wherein the valve timing control device of the invention is applied to intake valves of the internal combustion engine. However, of course, the device of the invention is applicable to exhaust valves of the internal combustion engine. These intake and exhaust valves are referred to engine operation valves in Claims.

Figure 1:
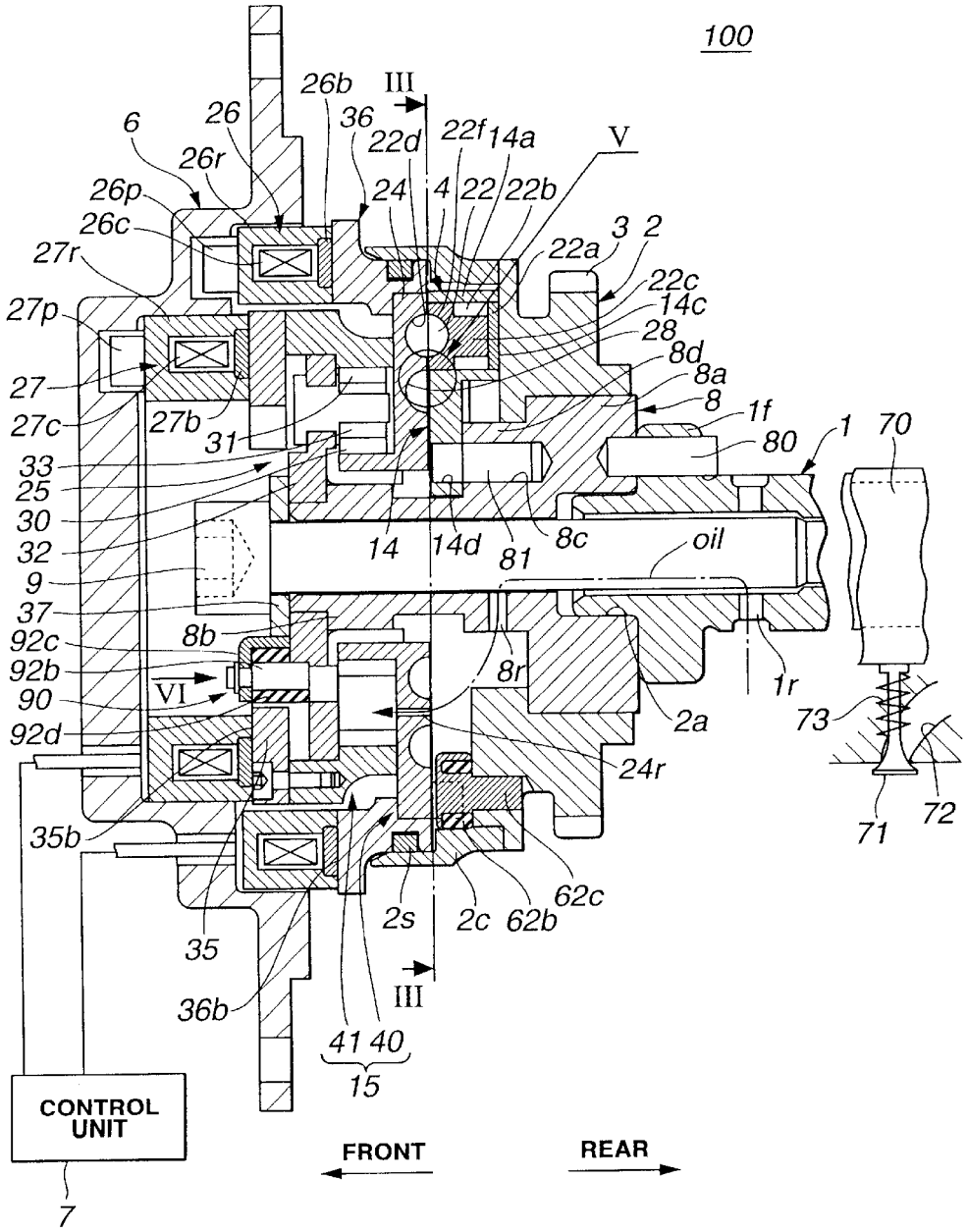
FIG. 1 is a sectional view of a valve timing control device of a first embodiment of the present invention.

Referring to FIGS. 1 to 6, particularly FIG. 1, there is shown a valve timing control device 100 of an internal combustion engine, which is a first embodiment of the present invention.

The valve timing control device 100 comprises generally a cam shaft 1, a drive plate 2, a relative angle controlling mechanism 4, an actuating device 15, a VTC cover 6 and a control unit 7.

Cam shaft 1 is a member for actuating or opening/closing intake valves 71 of the engine. Drive plate 2 is a member that is rotated by the engine. Relative angle controlling mechanism 4 is a mechanism for controlling or adjusting a relative angle between cam shaft 1 and drive plate 2 at will. Actuating device 15 is a device for actuating relative angle controlling mechanism 4. VTC cover 6 is a cover member that is mounted on front ends of a cylinder head and a rocker cover in a manner to cover front sides of drive plate 2 and relative angle controlling mechanism 4 and their surroundings. Control unit 7 is a means for controlling operation of actuating device 15 in accordance with an operation condition of the engine.

In the following, each of the above-mentioned parts will be described in detail with the aid of the accompanying drawings.

First, cam shaft 1 will be described with reference to FIG. 1. Cam shaft 1 is rotatably held on the cylinder head of the engine and has intake valve actuating cams 70 disposed thereon. Under rotation of cam shaft 1, each of cams 70 pushes the corresponding intake valve 71 to open an intake port 72 against a force of a valve spring 73. As shown, to a front end portion of cam shaft 1, there is fitted a spacer 8. That is, spacer 8 is fixed to a flange portion if of cam shaft 1 by means of pins 80, and thus, these two parts 8 and 1 rotate like a single unit. Cam shaft 1 is formed with a plurality of radially extending oil feeding bores 1*r*.

Figure 2:
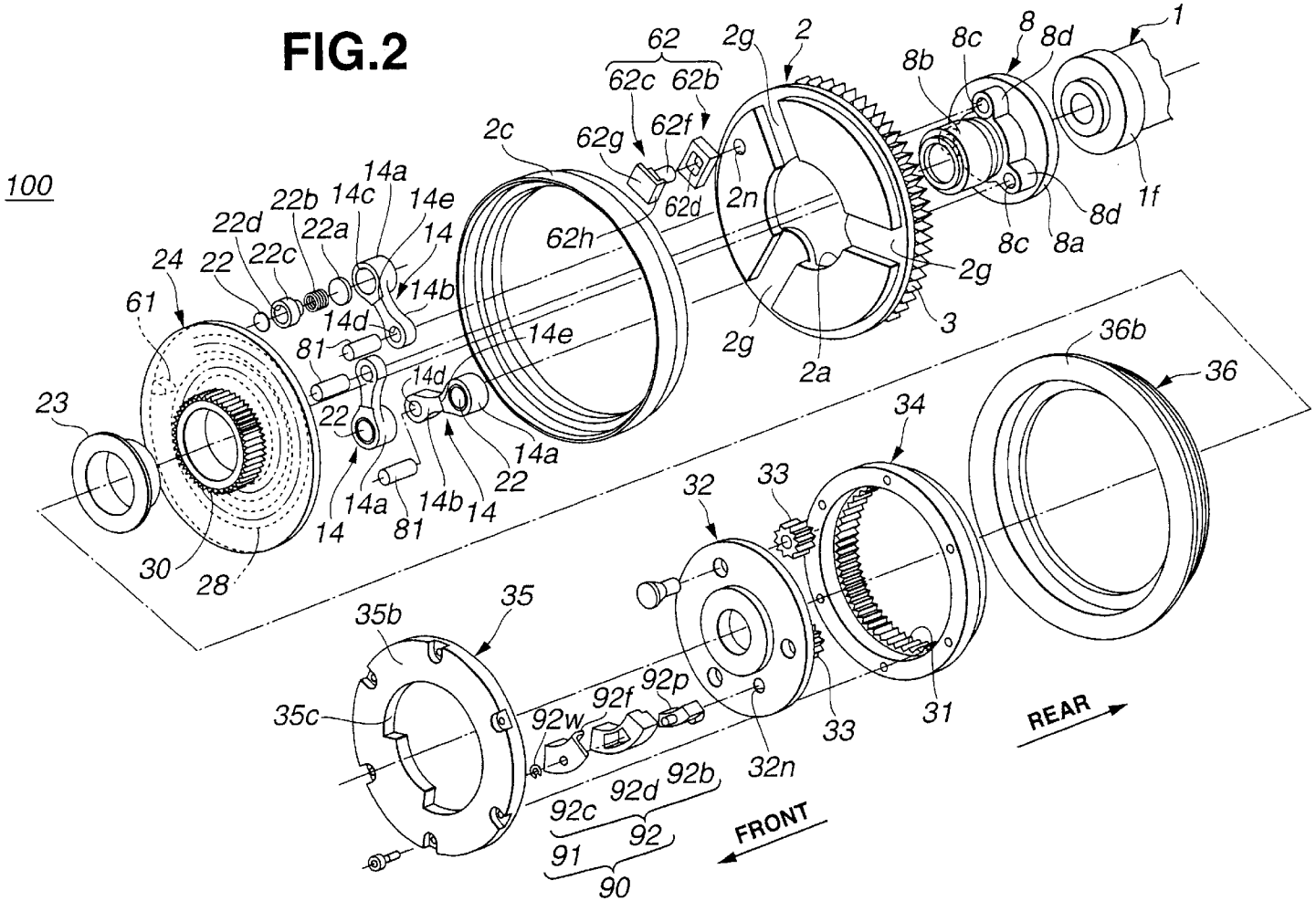
FIG. 2 is an exploded view of the valve timing control device of the first embodiment.

As is seen from FIG. 2, the spacer 8 comprises a circular engaging flange 8*a*, a tubular portion 8*b* that extends forward from the front surface of circular engaging flange 8*a* and evenly spaced three pin supporting portions 8*d* that are formed on the front surface of circular engaging flange 8*a* in a manner to surround a base portion of tubular portion 8*b*. That is, three pin supporting portions 8*d* are mutually spaced from one another by 120 degrees. Each pin supporting portion 8*d* has a bore 8*c* that extends in parallel with an axis of spacer 8. As is seen from FIG. 1, spacer 8 is formed with a radially extending oil feeding bore 8*r*.

As is seen from FIG. 2, drive plate 2 is a circular member having a center opening 2*a*. Drive plate 2 is mounted on spacer 8 in such a manner as to rotate relative to spacer 8 while being prevented from axially moving relative to spacer 8 by engaging flange 8*a*. As shown, drive plate 2 is formed on its periphery with a timing sprocket 3 to which a timing chain (not shown) from the engine is engaged to drive or rotate drive plate 2. A front surface of drive plate 2 is formed with evenly spaced three guide grooves 2*g* each extending from center opening 2*a* to the periphery of drive plate 2. That is, three guide grooves 2*g* are mutually spaced from one another by 120 degrees. Each guide groove 2*g* is defined by radially extending parallel opposed walls, as shown. An annular cover member 2*c* is secured to a front peripheral portion of drive plate 2 by means of welding or press fitting.

In the first embodiment 100 of the present invention, a driven rotation structure comprises cam shaft 1 and spacer 8, and a drive rotation structure comprises drive plate 2 having timing sprocket 3. It is to be noted that in place of the above-mentioned timing chain, other members, such as belt, gear and the like may be used for transmitting the engine rotation to drive plate 2.

Relative angle controlling mechanism 4 is arranged at front end portions of cam shaft 1 and drive plate 2 to vary or adjust a relative angle therebetween. As is seen from FIG. 2, relative angle controlling mechanism 4 includes three link arms 14. Each link arm 14 is formed at a leading end thereof with a cylindrical portion 14*a* that serves as a slide means. From cylindrical portion 14*a*, there extends radially outward an arm portion 14*b*. Each cylindrical portion 14*a* is formed with a bore 14*c* and each arm portion 14*b* is formed at a base end with an opening 14*d*.

Opening 14*d* of each link arm 14 is pivotally received on a pin 81 whose end is tightly fitted in bore 8*c* of the above-mentioned spacer 8. Thus, each link arm 14 is pivotal around the corresponding pin 81. While, cylindrical portions 14*a* of link arms 14 are slidably received in guide grooves 2*g* of the above-mentioned drive plate 2. Thus, each cylindrical portion 14*a* can slide in and along the corresponding guide groove 2*g*. If desired, each link arm 14 may be secured to the corresponding pin 81 to rotate like a single unit. However, in this case, pin 81 should be rotatably connected to spacer 8.

Accordingly, when, upon receiving an external force, cylindrical portions 14*a* of the three link arms 14 are slid in and along the corresponding guide grooves 2*g*, the three pins 81 are forced to move in a circumferential direction by an angle that corresponds to the displacement of cylindrical portions 14*a* in guide grooves 2*g*, due to a linking operation of link arms 14. Due to the circumferential movement of pins 81, cam shaft 1 is forced to rotate or turn relative to drive plate 2.

Figure 3:
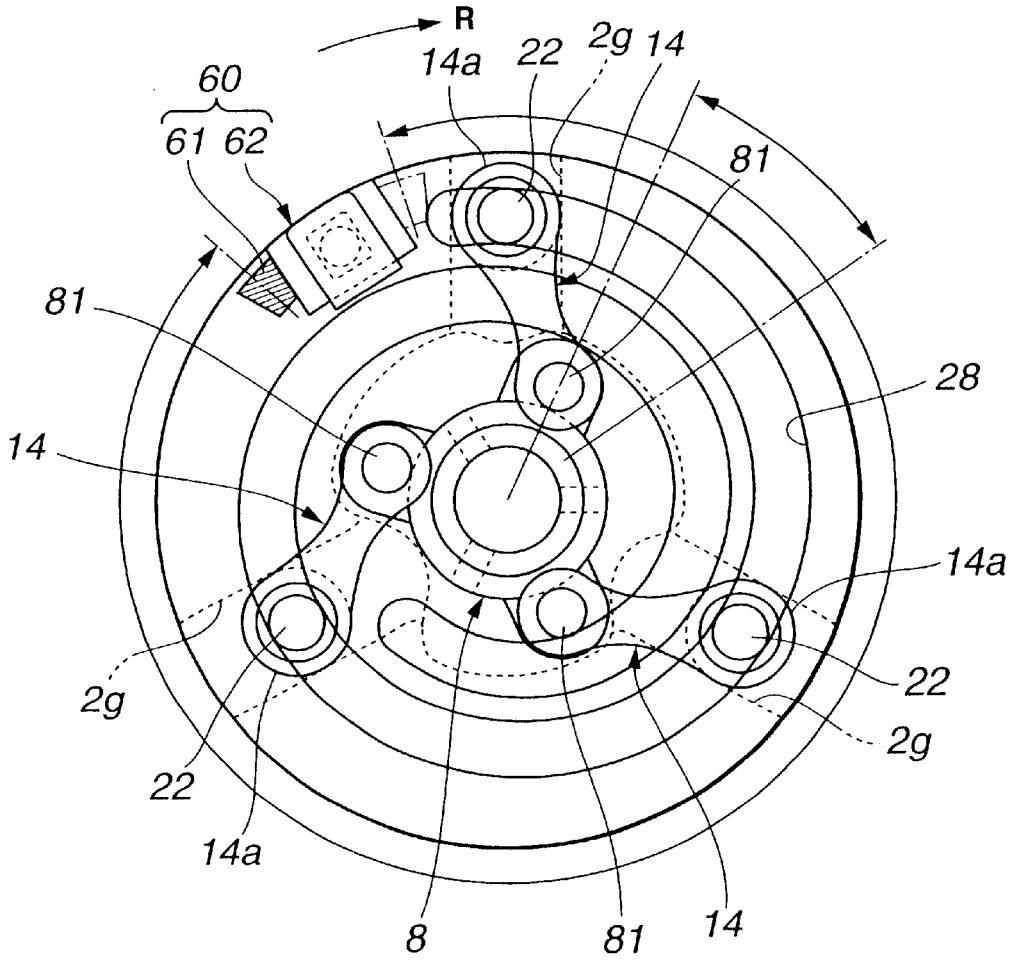
FIG. 3 is a sectional view taken along line III—III of FIG. 1, showing one operation condition of the valve timing control device of the first embodiment.
Figure 4:
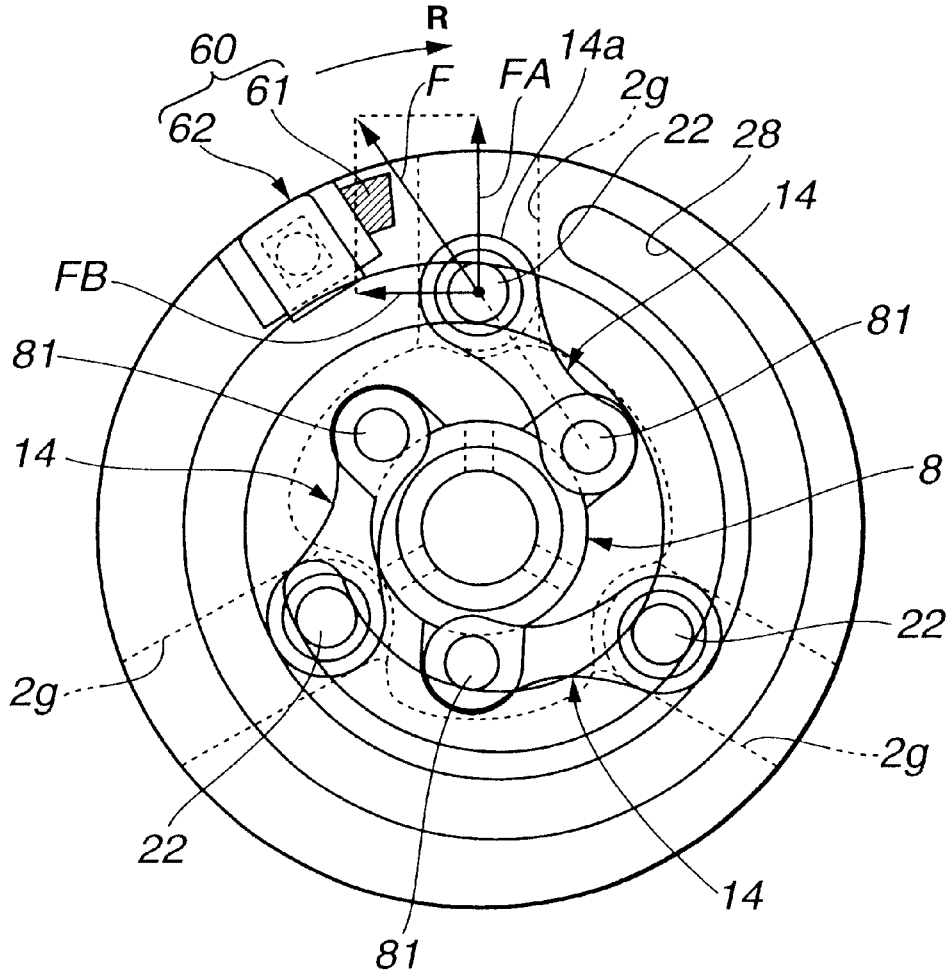
FIG. 4 is a view similar to FIG. 3, but showing a different operation condition of the valve timing control device of the first embodiment.

Operation of relative angle controlling mechanism 4 will be clarified from the following description directed to FIGS. 3 and 4.

That is, as is seen from FIG. 3, when the cylindrical portion 14*a* of each link arm 14 is placed at an outer side in the corresponding guide groove 2*g*, each guide pin 81 is kept pulled to a position near the corresponding guide groove 2*g*. Under this condition, the valve timing control device 100 of the present embodiment assumes the most-retarded angular position.

While, as is seen from FIG. 4, when the cylindrical portion 14*a* of each link arm 14 is placed at an inner side in the corresponding guide groove 2*g*, each guide pin 81 is kept pushed to a position away from the corresponding guide groove 2*g*. Under this condition, the valve timing control device 100 assumes the most-advanced angular position.

In the disclosed first embodiment 100, the most-retarded and most-advanced angular positions have an angular difference of about 30 degrees therebetween. However, the angular difference is not limited to such degrees. That is, the angular difference may vary depending on the performance of the engine.

Referring back to FIG. 1, the radial movement of cylindrical portion 14*a* of each link arm 14 is actuated by the above-mentioned actuating device 15. This actuating device 15 comprises an operation conversion mechanism 40 and a speed change mechanism 41.

As is seen from FIG. 2, operation conversion mechanism 40 comprises a ball 22 that is received in cylindrical portion 14 of each link arm 14 and a circular guide plate 24 that is coaxially arranged in front of the above-mentioned drive plate 2. Upon rotation of guide plate 24, cylindrical portions 14*a* of the three link arms 14 are forced to move in and along the corresponding guide grooves 2*g*. That is, operation conversion mechanism 40 is a mechanism for converting the rotation of guide plate 24 to a radial displacement of the cylindrical portion 14*a* of each link arm 14. The detail of operation conversion mechanism 40 will be described in the following.

As is seen from FIG. 2, guide plate 24 is rotatably disposed through a metal bush 23 on tubular portion 8*b* of the above-mentioned spacer 8. A rear surface of guide plate 24 is formed with a spiral guide groove 28. That is, spiral guide groove 28 is so shaped that a distance therefrom to a center of guide plate 24 gradually varies as guide groove 28 extends.

As is seen from FIG. 1, spiral guide groove 28 has a semicircular cross section, and guide plate 24 is formed at a middle portion of guide groove 28 with an oil feeding bore 24*r*.

Rotatably and slidably engaged with spiral guide groove 28 are the above-mentioned balls 22. That is, as is seen from FIGS. 1 and 2, in bore 14*c* of cylindrical portion 14*a* of each link arm 14, there are installed a circular lid panel 22*a*, a coil spring 22*b*, a retainer 22*c* and a ball 22 which are arranged in order. Each retainer 22*c* is formed with a concave recess 22*d* into which ball 22 is rotatably received with its front part projected forward. Due to function of coil spring 22*b*, ball 22 is biased outward, that is, leftward in the drawing. Furthermore, each retainer 22*c* (see FIG. 1) is formed with a flange 22*f* which serves as a spring seat for the corresponding coil spring 22*b*. Under condition of FIG. 1, each coil spring 22*b* is compressed thereby pressing the corresponding support panel 22*a* against the front surface of the above-mentioned drive plate 2 and at the same time pressing the corresponding ball 22 against spiral guide groove 28. That is, three balls 22 held by cylindrical portions 14*a* of the three link arms 14 are pressed against different portions of spiral guide groove 28. Thus, balls 22 are permitted to move in and along spiral guide grooves 28 while being guided by the same.

As is seen from FIGS. 3 and 4, spiral guide groove 28 is so shaped as to reduce its radius as drive plate 2 rotates in the direction of arrow R.

Accordingly, when, with balls 22 being engaged with spiral guide groove 28, guide plate 24 rotates relative to drive plate 2 in the direction of arrow R, each ball 22 is forced to run in spiral guide groove 28 in a radially outward direction. With the radially outward movement of three balls 22, cylindrical portions 14*a* of the three link arms 14 are forced to move radially outward in FIG. 3, and thus pins 81 connected to link arms 14 are forced to near guide groove 2*g*, rotating cam shaft 1 in a retarded direction.

When now guide plate 24 rotates relative to drive plate 2 in a direction opposite to the direction of arrow R, each ball 22 is forced to run in spiral guide groove 28 in a radially inward direction. With the radially inward movement of three balls 22, cylindrical portions 14*a* of the three link arms 14 are forced to move radially inward in FIG. 4, and thus pins 81 connected to link arms 14 are forced to move away from guide groove 2*g*, rotating cam shaft 1 in an advanced direction.

When relative angle controlling mechanism 4 and operation conversion mechanism 40 are properly assembled in the above-mentioned manner, a rear surface of cylindrical portion 14*a* of each link arm 14 is slidably engaged with a bottom surface of the corresponding guide groove 2*g* of drive plate 2, and a rear surface of opening 14*d* of each link arm 14 is slidably engaged with a front surface of the corresponding pin supporting portion 8*d* of spacer 8.

Figure 5:
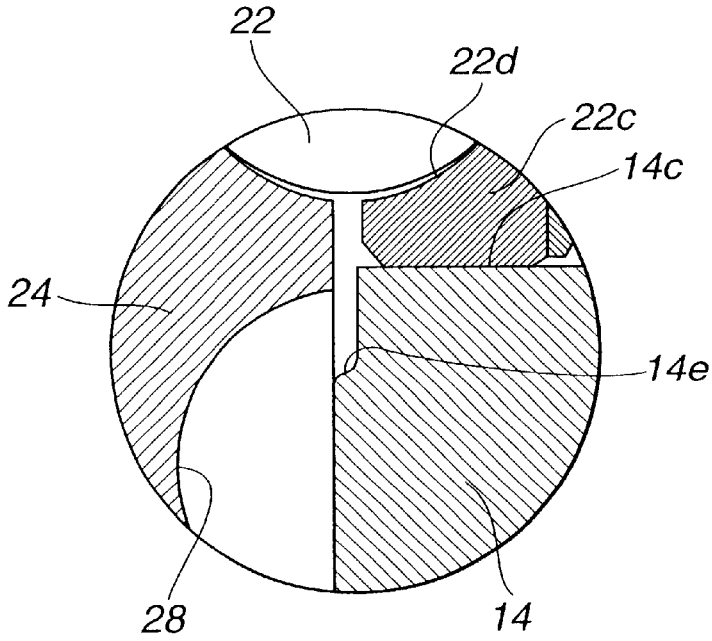
FIG. 5 is an enlarged view of a part indicated by an arrow "V" in FIG. 1.

As is seen from FIGS. 5 (viz., enlarged view of a part indicated by an arrow "V" of FIG. 1) and 2, each link arm 14 is formed, at a boundary portion between cylindrical portion 14*a* and arm portion 14*b*, with a smoothed step portion 14*e*. With this step portion 14*e*, a front surface of cylindrical portion 14*a* (or front peripheral edge of bore 14*c* of cylindrical portion 14*a*) of each link arm 14 is spaced from the rear surface of guide plate 24, as is seen from FIG. 5. Furthermore, as is seen from FIG. 5, under condition wherein balls 22 are properly engaged with spiral guide groove 28, each retainer 22*c* for retaining ball 22 is so arranged that a front peripheral edge portion thereof is spaced from the rear surface of guide plate 24.

As is seen from FIGS. 1 and 2, around drive plate 2 and guide plate 24, there is concentrically disposed the above-mentioned cover member 2*c* that is coaxially fixed to drive plate 2. Between an inner wall of cover member 2*c* and an after-mentioned annular first brake plate 36 integrally mounted on an outer wall of guide plate 24, there is disposed a seal member 2*s*. With this seal member 2*s*, sliding portions of link arms 14 and contacting portions between balls 22 and spiral guide groove 28 are prevented from contamination.

In the following, speed change mechanism 41 of actuating device 15 will be described in detail with reference to the drawings, particularly FIGS. 1 and 2.

Speed change mechanism 41 is a mechanism for speeding up or down the above-mentioned guide plate 24 relative to drive plate 2. That is, speed change mechanism 41 functions to move or rotate guide plate 24 relative to drive plate 2 in the direction of arrow R (speed up) or in the opposite direction (speed down).

As is seen from FIG. 1, speed change mechanism 41 comprises a planetary gear unit 25, a first electromagnetic brake 26 and a second electromagnetic brake 27.

As is seen from FIG. 2, planetary gear unit 25 comprises a sun gear 30, a ring gear 31 and planetary gears 33 each being meshed with sun and ring gears 30 and 31. In the illustrated first embodiment 100, sun gear 30 is integrally formed on front side of guide plate 24. Planetary gears 33 are rotatably held on a circular carrier plate 32 that is secured to a front end portion of the above-mentioned spacer 8. Ring gear 31 is formed on a cylindrical inner wall of an annular member 34 that is rotatably disposed around carrier plate 32.

As is seen from FIG. 1, carrier plate 32 is disposed on a front end of spacer 8 and secured to the same with the aid of a washer 37 that is compressed between carrier plate 32 and a head of a bolt 9 that is coaxially screwed into cam shaft 1.

As is seen from FIG. 2, an annular second brake plate 35 is secured to a front surface of annular member 34 by means of bolts. Second brake plate 35 has a work (or braking) surface 35*b* on its front side. Onto the periphery of guide plate 24 on which sun gear 30 is integrally formed, there is concentrically and tightly disposed the above-mentioned first brake plate 36 which has a work (or braking) surface 36*b* on its front side. Welding or press fitting may be used for securing first brake plate 36 to guide plate 24.

Accordingly, when, with first and second electromagnetic brakes 26 and 27 being in inoperative condition, planetary gears 33 make a revolution together with carrier plate 32 without rotation thereof, sun gear 30 and ring gear 31 are forced to rotate at the same speed.

When now only first electromagnetic brake 26 is operated to work, guide plate 24 is turned relative to carrier plate 32 (or cam shaft 1) in a retarded direction (viz., in a direction opposite to the direction of arrow R in FIGS. 3 and 4), so that drive plate 2 and cam shaft 1 make a relative angular displacement in an advanced direction.

While, when only second electromagnetic brake 27 is operated to work, a brake force is applied to only ring gear 31 and thus ring gear 31 is turned relative to carrier plate 32 in a retarded direction causing rotation of planetary gears 33. Rotation of planetary gears 33 speeds up sun gear 30, so that guide plate 24 is turned relative to drive plate 2 in the direction of arrow R causing drive plate 2 and cam shaft 1 to make a relative angular displacement in a retarded direction as shown in FIG. 3.

In the disclosed embodiment 100, carrier plate 32 constitutes an input element, sun gear 30 and guide plate 24 constitute output elements and ring gear 31, annular member 34 and second brake plate 35 constitute free elements.

As is seen from FIG. 1, first and second electromagnetic brakes 26 and 27 have respective ring members 26*r* and 27*r* which are coaxially arranged to face work surfaces 36*b* and 35*b* of first and second brake plates 36 and 35 respectively. Each ring member 26*r* or 27*r* is loosely held by the above-mentioned VTC cover 6 by means of pins 26*p* or 27*p*, while being suppressed from rotation about its axis. Within each ring member 26*r* or 27*r*, there is installed a coil 26*c* or 27*c*. Furthermore, each ring member 26*r* or 27*r* is equipped with a friction member 26*b* or 27*b* that is pressed against the above-mentioned work surface 35*b* or 36*b* when coil 26*c* or 27*c* becomes energized. If desired, a modification may be employed wherein a biasing member is connected to at least one of friction members 26*b* and 27*b* to constantly bias friction member 26*b* or 27*b* toward work surface 35*b* or 36*b* and when coil 26*c* or 27*c* is energized, friction member 26*b* or 27*b* is moved away from work surface 35*b* or 36*b* against the force of biasing member.

Rings members 26*r* and 27*r* and first and second brake plates 36 and 35 are made of a magnetic material such as iron or the like, which forms a magnetic field when coils 26*c* and 27*c* are energized. While, VTC cover 6 is made of a non-magnetic material such as aluminum or the like, which prevents undesired leakage of magnetic flux. Furthermore, friction members 26*b* and 27*b* are also made of a non-magnetic material, such as aluminum or the like. That is, if friction members 26*b* and 27*b* are made of a magnetic material, magnetization of these friction members 26*b* and 27*b*, which would be induced by repeated energization of coils 26*c* and 27*c*, tends to induce an undesirable phenomenon wherein friction members 26*b* and 27*b* are forced to touch work surfaces 36*b* and 35*b* of first and second brake plates 36 and 35 even when coils 26*c* and 27*c* are not energized.

As is seen from FIGS. 2 and 3, a relative rotation between guide plate 24, that is provided with sun gear 30 of planetary gear unit 25, and drive plate 2 is controlled or restricted between the most-retarded and most-advanced angular positions by a first stopper device 60.

As is seen from FIG. 2, first stopper device 60 comprises a guide side member 61 and a drive side member 62. Guide side member 61 is a metal piece integrally provided on a peripheral portion of the rear surface of guide plate 24. If desired, such metal piece may be connected to guide plate 24 by means of welding or bolt. Drive side member 62 comprises an elastic member 62*b* and a connecting member 62*c*. Elastic member 62*b* is shaped into a rectangular parallelepiped and made of a shock absorbing material such as rubber, elastic plastic or the like. Elastic member 62*b* has a central bore 62*d* formed therethrough. Connecting member 62*c* comprises a shaft 62*f* which is to be press-fitted into an opening 2*n* of drive plate 2 and a press plate 62*g* which is secured to a leading end of shaft 62*f*. Press plate 62*g* has a generally L-shaped cross section. To assembling drive side member 62, shaft 62*f* is inserted into central bore 62*d* of elastic member 62*b* and strongly press-fitted into opening 2*n* of drive plate 2. With this, elastic member 62*b* is tightly fitted to the front surface of drive plate 2 having press plate 62*g* mounted on a front side thereof. Press plate 62*g* has a flange portion 62*h* pressed on a side surface of elastic member 62*b*. With this flange portion 62*h*, free rotation of elastic member 62*b* about shaft 62*f* and excessive elastic deformation of elastic member 62*b* are suppressed.

Upon assuming the most-retarded angular position as is shown in FIG. 3, guide side member 61 contacts to a trailing side of drive side member 62, with respect to the rotation direction of arrow R, thereby suppressing relative rotation between guide plate 24 and drive plate 2. Under this condition, the ball 22 placed at the outermost area of spiral guide groove 28 does not contact to the outermost end of groove 28. This means that, under operation of the valve timing control device 100, the outermost ball 22 never contacts to the outermost end of groove 28, and thus, durability of the ball 22 and that of the outermost end of groove 28 are assured.

While, upon assuming the most-advanced angular position as shown in FIG. 4, guide side member 61 contacts to a leading side of drive side member 62, with respect to the rotation direction of arrow R, thereby suppressing relative rotation between guide plate 24 and drive plate 2. Under this condition, the ball 22 placed at the innermost area of spiral guide groove 28 does not contact to the innermost end of groove 28. That means that, under operation of the valve timing control device 100, the innermost ball 22 never contacts to the innermost end of groove 28, and thus, durability of the ball 22 and that of the innermost end of groove 28 are assured.

As is seen from FIG. 2, a second stopper device 90 is incorporated with planetary gear unit 25. That is, between second brake plate 35, that is integrally connected to ring gear 31 of planetary gear unit 25, and carrier plate 32, that serves as an input element, there is provided the second stopper device 90.

Second stopper device 90 comprises a stopper plate 91 that is connected to second brake plate 35 in a manner to project into a central opening 35*c* of second brake plate 35 and a carrier side member 92 that is fixed to carrier plate 32. These two members 91 and 92 are contactable to each other when a relative rotation takes place between second brake plate 35 and carrier plate 32. Carrier side member 92 comprises a metallic base member 92*b* that is fitted to a connecting opening 32*n* of carrier plate 32, an arcuate elastic member 92*d* that is mounted to metal base member 92*b* to cover the same and a metallic cover member 92 that covers front and inner surfaces of arcuate elastic member 92*d*. Elastic member 92*d* is made of a shock absorbing material such as rubber, elastic plastic or the like. Cover member 92*c* is formed with a flange portion 92*f* that holds a side surface of arcuate elastic member 92*d*. With this flange portion 92*f*, free rotation of elastic member 92*d* about base member 92*b* and excessive elastic deformation of elastic member 92*d* are suppressed. Furthermore, a washer 92*w* is fixed a pin 02*p* extending from base member 92*b* for holding cover member 92*c* in position.

Figure 6:
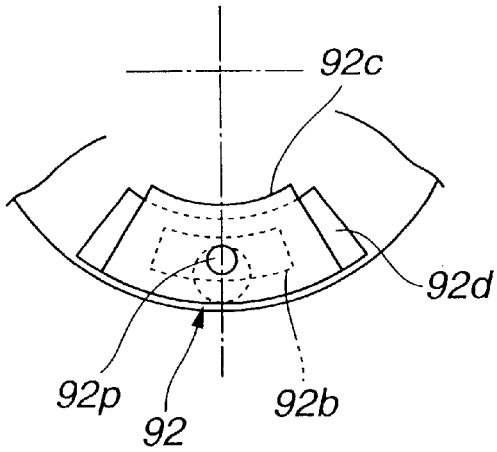
FIG. 6 is a view of a part indicated by an arrow "VI" in FIG. 1.

As is seen from FIG. 6 that is taken from the direction of arrow "VI" of FIG. 1, a rotation center of base member 92*b* and that of cover member 92 are located at different positions, and thus, even when applied with an external force from a circumferential direction, these base member 92*b* and cover member 92 are prevented from making an integral rotation.

When, in planetary gear unit 25, second electromagnetic brake 27 is operated to work, ring gear 31 is turned relative to carrier plate 32 in a retarded direction causing rotation of planetary gears 33 speeding up sun gear 30. When, under this condition, carrier plate 32 is turned by a certain angle relative ring gear 31 with the aid of rotation of planetary gears 33, turning of carrier plate 32 is stopped by second stopper device 90. Accordingly, when sun gear 30 is speeded up and displaced in a retarded direction and thus relative rotation between guide plate 24 and drive plate 2 is stopped by the above-mentioned first stopper device 60, a counterforce thus produced is supported by second stopper device 90 through planetary gears 33 and carrier plate 32, that is, such counterforce is not supported by meshed parts between planetary gears 33 and ring gear 31. Thus, durability of planetary gears 33 and that of ring gear 31 are assured.

In the above-mentioned operation conversion mechanism 40, by keeping the position of cylindrical portion 14*a* of each link arm 14, a relative positioning between drive plate 2 and cam shaft 1 is kept unchanged. This will be clarified from the following description.

From drive plate 2 to cam shaft 1, there is transmitted a drive torque through link arms 14 and spacer 8. During this, from cam shaft 1 to rink arms 14, there is inputted a variable torque (viz., alternating torque) of cam shaft 1 caused by a counterforce from intake valves 71 of engine (viz., counterforce by valve springs 73). That is, as is understood from FIG. 4, such variable torque is applied to each rink arm 14 as a force "F" that has a direction from pin 81 to pivoted portions of both ends of the rink arm 14.

As is described hereinabove, cylindrical portions 14*a* of three link arms 14 are radially movably guided by the corresponding guide grooves 2*g* and three balls 22 exposed from cylindrical portions 14*a* are movably engaged with spiral guide groove 28. Accordingly, the force "F" applied through link arms 14 is supported by opposed side walls of each guide groove 2*g* and spiral guide groove 28 of guide plate 24.

Accordingly, the force "F" applied to each link arm 14 is divided into two components "FA" and "FB" whose directions are perpendicular to each other. These components "FA" and "FB" are supported by the outer side wall of spiral guide groove 28 and one of opposed side walls of each guide groove 2*g* at substantially right angles, and thus, movement of cylindrical portion 14*a* of each link arm 14 along the guide groove 2*g* is suppressed thereby preventing rotation of each link arm 14.

Accordingly, once, by the braking force produced by first and second electromagnetic brakes 26 and 27, rink arms 14 are moved or turned to their given positions due to rotation of guide plate 24, link arms 14 can basically keep their given positions without receiving the braking force. That is, the relative operation phase between drive plate 2 and cam shaft 1 can be kept unchanged. It is to be noted that the force "F" is not always applied in a radially outward as shown in FIG. 4. That is, such force "F" can be applied in an opposite direction. In this case, the components "FA" and "FB" of force "F" are supported by the inner side wall of spiral guide groove 28 and the other one of opposed side walls of each guide groove 2*g* at substantially right angles.

In the following, operation of valve timing control device 100 of the first embodiment will be described.

At engine starting or under engine idling, operation phase of crankshaft (not shown) and cam shaft 1 is controlled to the most-retarded side for improving engine rotation stability and fuel consumption.

In order to control cam shaft 1 to the most-retarded side, control unit 7 issues an instruction signal to energize second electromagnetic brake 27. Upon this, friction member 27*b* of second electromagnetic brake 27 is frictionally engaged with second brake plate 35, and thus, ring gear 31 of planetary gear unit 25 is applied with a braking force thereby speeding up sun gear 30 in accordance with rotation of timing sprocket 3. Due to the increased speed of ring gear 31, guide plate 24 is turned relative to drive plate 2 in the direction of the arrow "R", and balls 22 held by link arms 14 are moved in spiral guide groove 28 toward a radially outer side. As is understood from FIG. 3, the radially outward movement of balls 22 is stopped at the most-retarded angular position where guide side member 61 of first stopper device 60 abuts against drive side member 62 of the same. At this stop position, cam shaft 1 is forced to assume the most-retarded angular position relative to drive plate 2. Due to provision of elastic member 62*b* of first stopper device 60, abutment of guide side member 61 against drive side member 62 produces no noisy sound.

The braking of ring gear 31 by second electromagnetic brake 27 is smoothly carried out. In other words, the braking is gradually carried out while permitting a predetermined small rotation of ring gear 31. When the rotation of ring gear 31 reaches a predetermined degree, the rotation of ring gear 31 is stopped by second stopper device 90. That is, when carrier side member 92 of carrier plate 32 abuts against one side of stopper plate 91, rotation of ring gear 31 is stopped. When, as is described hereinabove, the increased rotation of guide plate 24, on which sun gear 30 is provided, is stopped by first stopper device 60, a counterforce is applied to planetary gear unit 25. That is, the counterforce is transmitted from carrier plate 32 to second brake plate 35 of the side of ring gear 31 through second stopper device 90, that is, such counterforce is not supported by meshed parts between the mutually engaged gears. Thus, durability of gears is assured. Due to provision of elastic member 92*d* on carrier side member 92, abutment of stopper plate 91 against carrier side member 92 produces no noisy sound.

It is to be noted that energization of second electromagnetic brake 27 is made for only a given short time, for example, 0.5 sec. or so. After deenergization of brake 27, the above-mentioned holding function of operation conversion mechanism 40 keeps the most-retarded angular position of cam shaft 1.

Basically, the instruction signal for achieving the most-retarded angular position of cam shaft 1 is stopped when the associated engine is turned off. Thus, when the engine is thereafter started, cam shaft 1 shows the most-retarded angular position. However, even in this starting condition of the engine, it is preferable to issue such instruction signal as to control cam shaft at the most-retarded angular position.

When the engine is shifted to a normal operation condition from the above-mentioned starting or idling condition and control unit 7 judges need of angular advancing of cam shaft 1, control unit 7 issues an instruction signal for energizing first electromagnetic brake 26.

Upon this, guide plate 24 is applied with a braking force and thus forced to turn relative to drive plate 2 in a direction opposite to the direction of arrow "R". With this, cam shaft 1 is turned in an advanced direction inducing high power operation of the engine. The amount of turning of cam shaft 1 is controlled by a feedback system (not shown) that monitors the turning. When cam shaft 1 is turned to the most-advanced angular position, guide side member 61 of first stopper device 60 comes into abutment with drive side member 62 of the same as is seen from FIG. 4, and thus further turning of cam shaft 1 is suppressed. Accordingly, cam shaft 1 is forced to assume the most-advanced angular side relative to drive plate 2. This angular position of cam shaft 1 is kept by the holding function of operation conversion mechanism 40.

When rotation of guide plate 24 is stopped, planetary gears 33 are rotated increasing rotation speed of ring gear 31. When the rotation of ring gear 31 reaches a predetermined degree, the rotation of ring gear 31 is stopped by second stopper device 90. Accordingly, also in this case, no counterforce is applied to meshed parts between mutually engaged gears, and thus, durability of such gears is assured.

As is understood from FIG. 1, under operation of valve timing control device 100, a lubrication oil from the engine is led into oil feeding bores 1*r* of cam shaft 1 and into an inner bore of spacer 8, and then the oil is led into oil feeding bore 8*r* of spacer 8 toward relative angle controlling mechanism 4 and actuating device 15. Then, the oil is led to planetary gear unit 25 through guide plate 24 and oil feeding bore 24*r*. The flow path of the lubrication oil is schematically indicated by a phantom line (oil) in FIG. 1. During flow in the flow path, the oil is fed to spiral guide groove 28 and to link arms 14. Thus, operation of link arms 14 is smoothly made.

As is described hereinabove, in the valve timing control device 100 of this first embodiment, the rotation speed of guide plate 24 is controlled by planetary gear unit 25 and two electromagnetic brakes 26 and 27, and by using the speed control of guide plate 24, link arms 14 of relative angle controlling mechanism 4 are actuated. Accordingly, each of the two electromagnetic brakes 26 and 27 needs only a braking force that overcomes an operation resistance of link arms 14 and a frictional resistance that is produced between each work surface 36*b* or 35*b* of first or second brake plate 36 or 35 and each link arm 14. Accordingly, electromagnetic force needed by electromagnetic brakes 26 and 27 can be reduced and thus energy saving is obtained.

If desired, the following modifications may be applied to the above-mentioned first embodiment 100.

In planetary gear unit 25 of the disclosed embodiment 100, sun gear 30 is served as an output element, carrier plate 32 is served as an input element and ring gear 31 is served as a free element. However, if carrier plate 32 is arranged to serve as an input element, ring gear 31 can be served as an output element and sun gear 30 can be served as a free element. Of course, in this modification, guide plate 24 is formed with a ring gear.

In planetary gear unit 25 of the disclosed embodiment 100, the speed control of sun gear 30 is made by applying a braking force to sun gear 30 or ring gear 31. However, if desired, the speed control of sun gear 30 may be made by using an electric motor that positively and negatively drives sun gear 30.

In first and second stopper devices 60 and 90 of the disclosed embodiment 100, an elastic member 62*b* or 92*d* is provided on one of the contacting and contacted members. However, such elastic member may be applied to both the contacting and contacted members.

Figure 7:
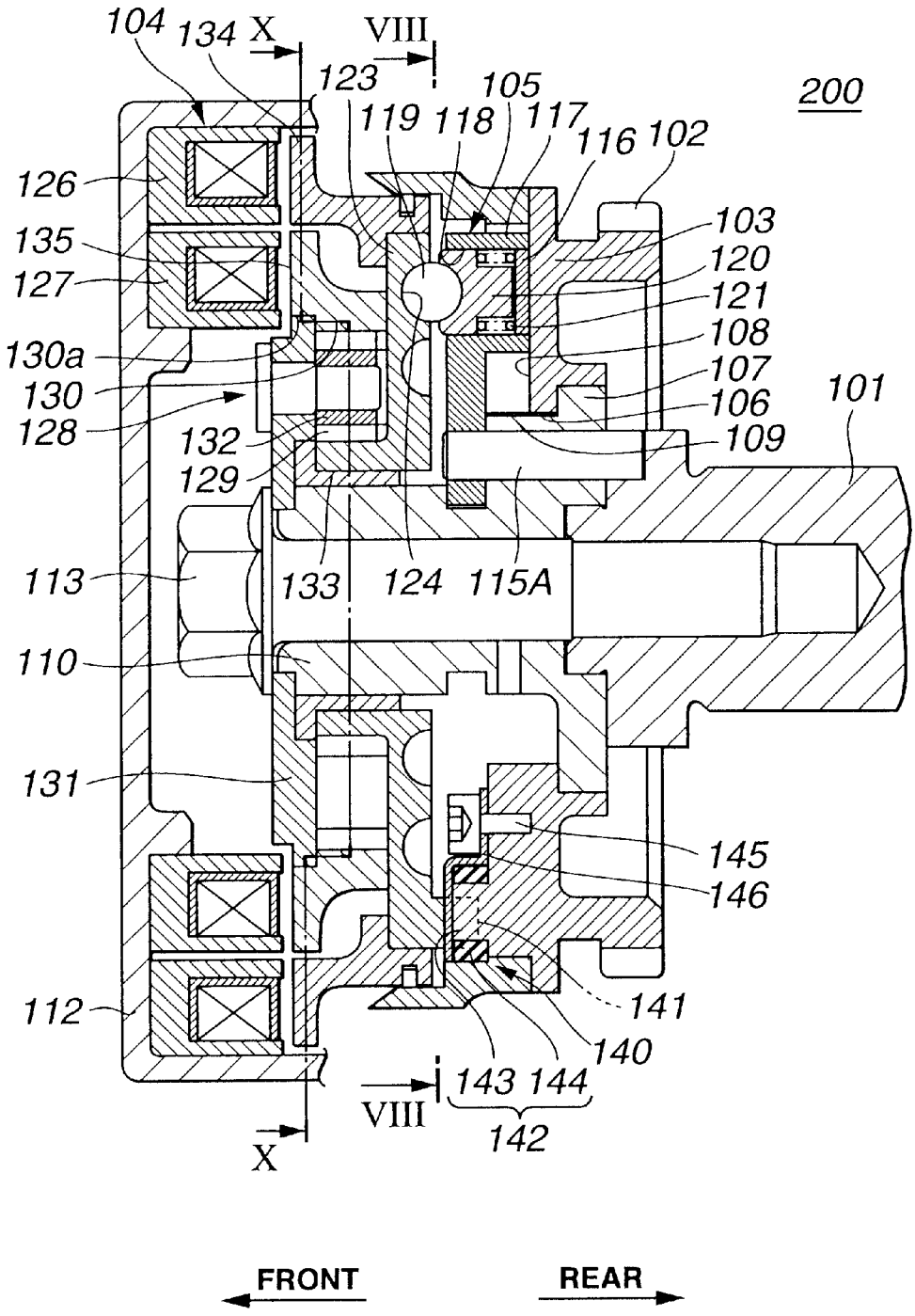
FIG. 7 is a sectional view of a valve timing control device of a second embodiment of the present invention.
Figure 8:
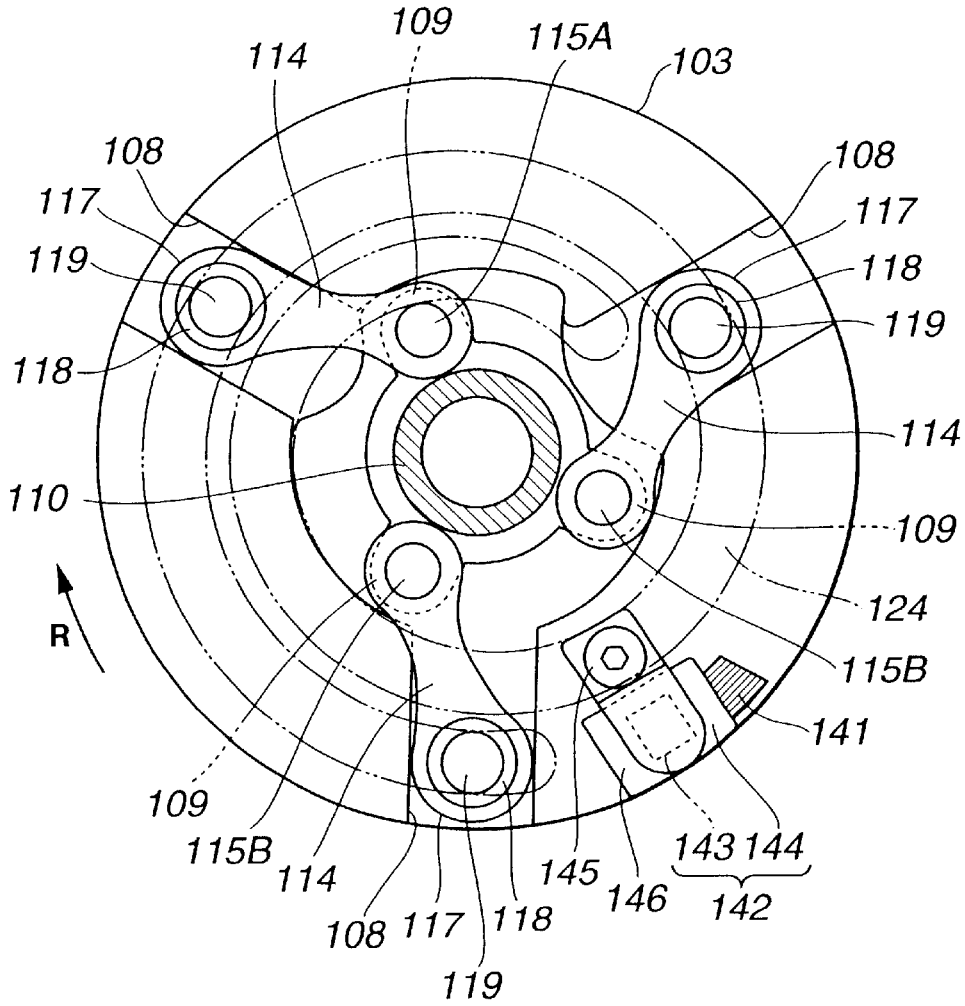
FIG. 8 is a sectional view taken along the line VIII—VIII of FIG. 7, showing one operation condition of the valve timing control device of the second embodiment.

Referring to FIGS. 7 to 12, particularly FIG. 7, there is shown a valve timing control device 200 of an internal combustion engine, which is a second embodiment of the present invention.

As is seen from FIG. 7, the valve timing control device 200 comprises generally a cam shaft 101 that is rotatably mounted on a cylinder head (not shown) of an associated internal combustion engine, a drive plate 103 that is rotatably mounted on a front end portion of cam shaft 101 and formed with a timing sprocket 102 thereabout, a relative angle controlling mechanism 105 that is arranged at a front portion of drive plate 103 and cam shaft 101 to adjust relative angle between these two parts 103 and 101, an actuating device 104 that is arranged at a front portion of relative angle controlling mechanism 105 to actuate the same and a VTC cover 112 that is mounted on front ends of a cylinder head and a rocker cover in a manner to cover front parts of relative angle controlling mechanism 105 and actuating device 104. Although not shown in the drawing, a timing chain from a crankshaft of the engine is put on timing sprocket 102 to drive the same.

Figure 9:
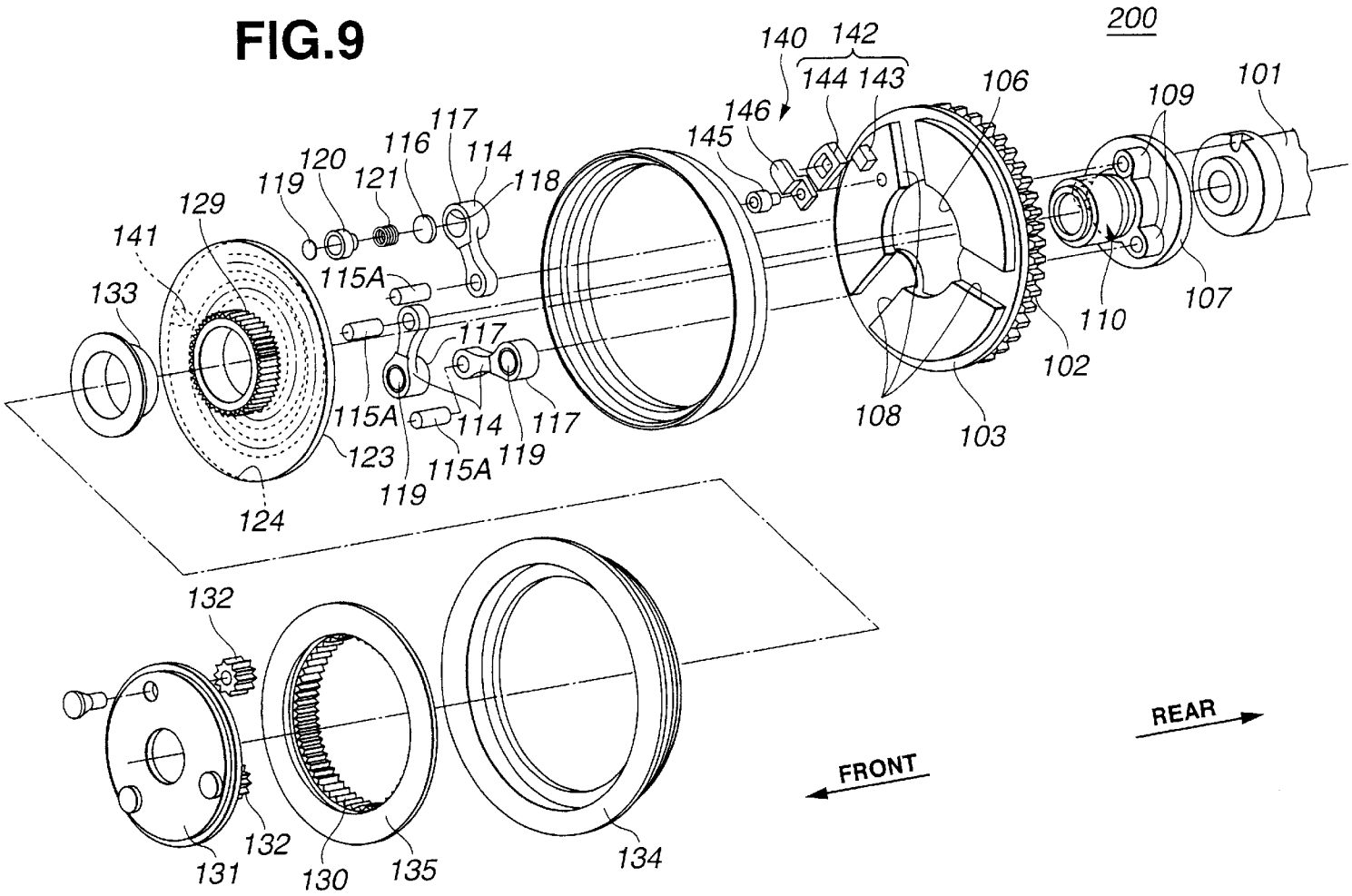
FIG. 9 is an exploded view of the valve timing control device of the second embodiment.
Figure 10:
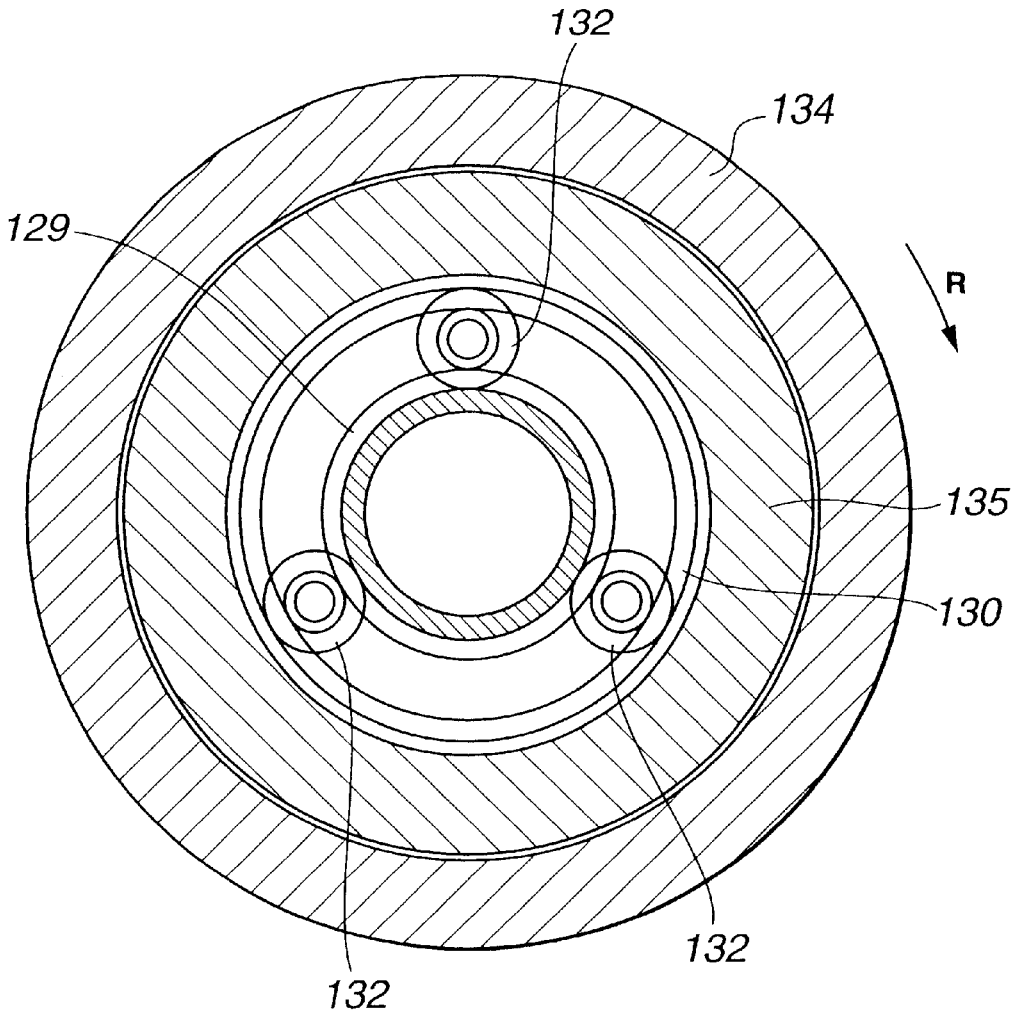
FIG. 10 is a sectional view taken along the line X—X of FIG. 7.
Figure 11:
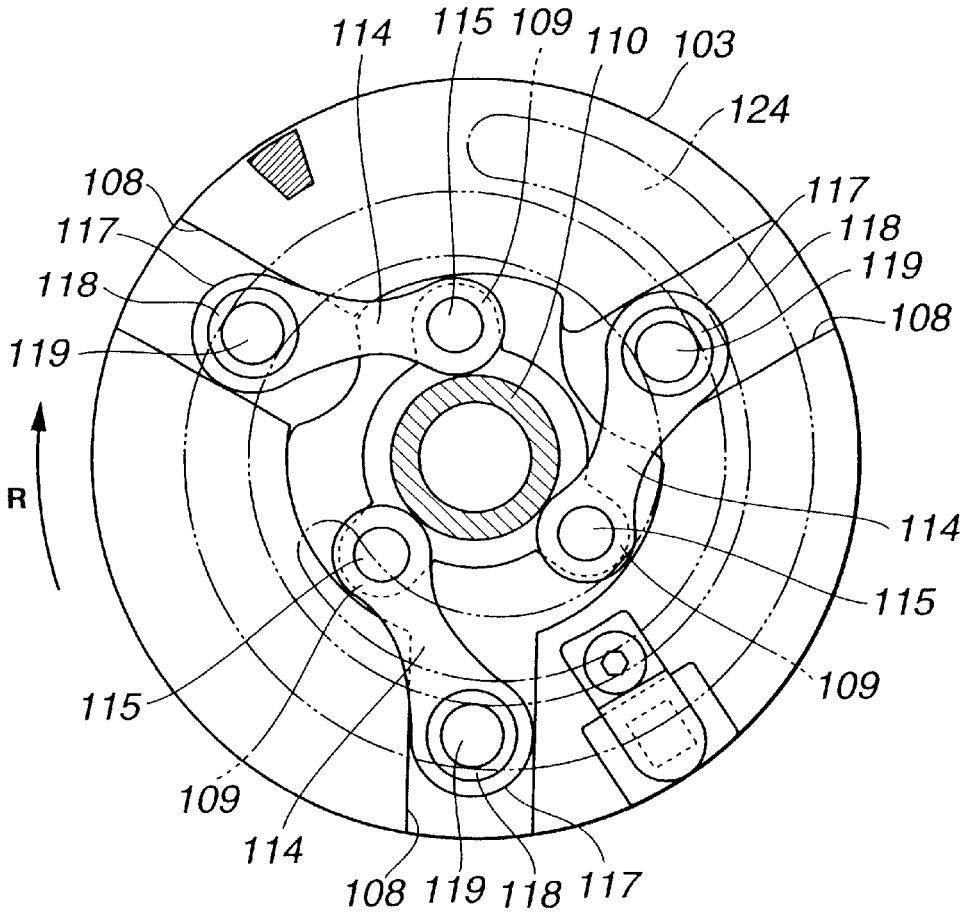
FIG. 11 is a view similar to FIG. 8, but showing another operation condition of the valve timing control device of the second embodiment.
Figure 12:
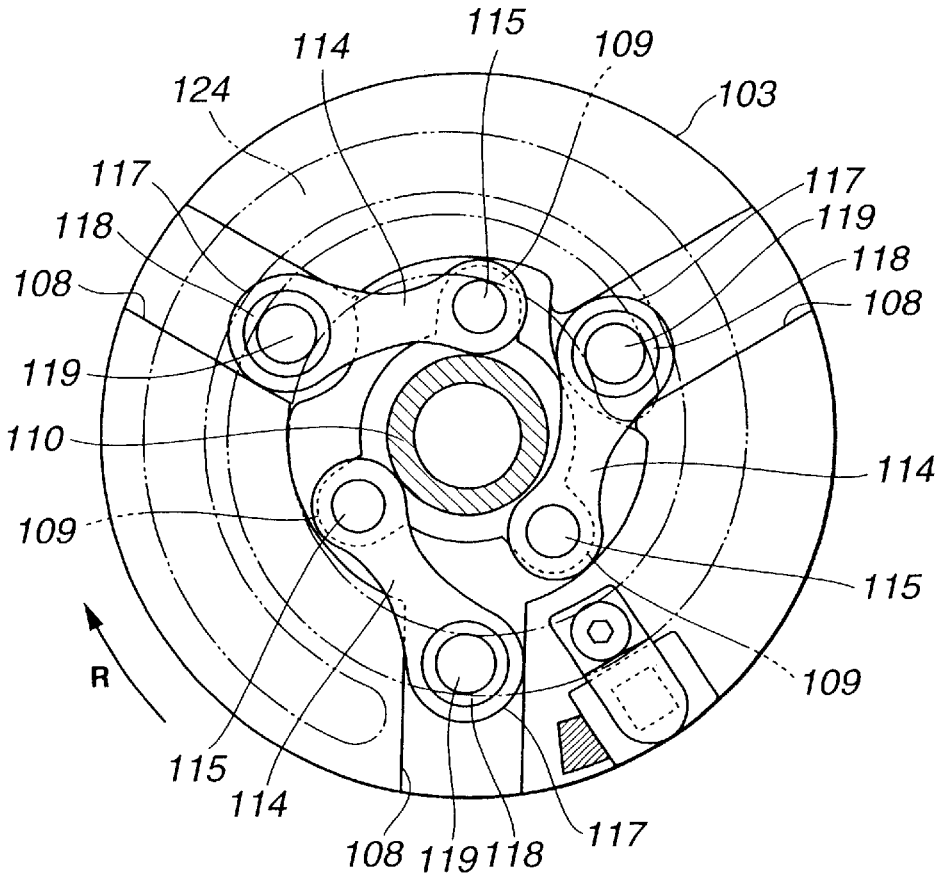
FIG. 12 is a view similar to FIG. 8, but showing still another operation condition of the valve timing control device of the second embodiment.

As is seen from FIG. 9, drive plate 103 is a circular member having a center opening 106, and rotatably disposed, through center opening 106 thereof, about a spacer 110 that is integrally connected to a front end of cam shaft 101. A front surface of drive plate 103 is formed with evenly spaced three guide grooves 108 each extending radially. These guide grooves 108 are mutually spaced from one another by 120 degrees. Each guide groove 108 is defined by radially extending parallel opposed walls, as shown. Spacer 110 is formed with a circular engaging flange 107 and evenly spaced three pin supporting portions 109 which are arranged on a front side of circular engaging flange 107.

As is seen from FIG. 7, a bolt 113 passing through a bore of spacer 110 is screwed into a threaded bore of cam shaft 101 to secure spacer 110 to cam shaft 101.

Referring back to FIG. 9, three pins 115A are press-fitted into respective bores of the three pin supporting portions 109 to pivotally support base ends of link pins 114. These link pins 114 have at leading ends thereof respective cylindrical portions 117 that are slidably engaged with guide grooves 108.

That is, each link arm 114 is pivotally connected to spacer 110 through pin 115A having cylindrical portion 117 thereof kept engaged guide groove 108. Thus, when cylindrical portions 117 of link arms 114 are moved along respective guide grooves 108 upon receiving an external force at leading ends of link arms 114, drive plate 103 and spacer 110 are forced to make a relative rotation by a degree corresponding to the displacement of cylindrical portions 117. Each cylindrical portion 117 is formed with a bore 118 into which there are installed a circular lid panel 116, a coil spring 121, a retainer 120 and a ball 119 which are arranged in order. Retainer 120 is formed a concave recess into which ball 119 is rotatably received with its front part projected forward. Due to function of coil spring 121, each ball 119 is biased leftward in the drawing (FIG. 9). As will be described in the following, the three balls 119 are movably engaged with a spiral guide groove 124.

A circular guide plate 123 is rotatably arranged in front of the above-mentioned drive plate 103. That is, this plate 123 has a center opening that is rotatably disposed about a tubular portion of spacer 110 that passes through center opening 106 of drive plate 103. A rear surface of circular guide plate 123 is formed with a spiral guide groove 124 which has a semicircular cross section (see FIG. 7). The above-mentioned spring biased three balls 119 are pressed against different portions of this spiral guide groove 124. As is seen from FIG. 8, spiral guide groove 124 is so shaped that a distance therefrom to a center of guide plate 123 gradually reduces along the rotation direction "R" of drive plate 103. Accordingly, when, with all balls 119 kept engaged with spiral guide groove 124, circular guide plate 123 is rotated relative to drive plate 103 in a retarded direction, cylindrical portions 117 of link arms 114 are moved radially inward in the groove 124. While, when circular guide plate 123 is rotated in an opposite or advanced direction, cylindrical portions 117 are moved radially outward in the groove 124.

That is, relative angle controlling mechanism 105 thus comprises generally three guide grooves 108 of drive plate 103, cylindrical portions 117, balls 119, link arms 114, pin supporting portions 109 and spiral guide groove 124 of circular guide plate 123. When a force is applied from actuating device 104 to circular guide plate 123 relative to cam shaft 101, the force causes cylindrical portion 117 of each link arm 114 to move radially on the rear surface of circular guide plate 123 due to a slidable engagement between each ball 119 and spiral guide groove 124. Upon this, due to function of the connection between each link arm 114 and corresponding pin supporting portion 109, drive plate 103 and cam shaft 101 are forced to make a relative rotation.

As is seen from FIG. 7, actuating device 104 comprises generally first and second electromagnetic brakes 126 and 127 and a planetary gear unit 128. That is, by switching operation of two electromagnetic brakes 126 and 127, circular guide plate 123 is selectively applied with a force in a retarded direction or a force in an advanced direction.

As is seen from FIGS. 7 and 9, planetary gear unit 128 comprises generally a sun gear 129 integrally informed on circularly guide plate 123, a ring gear 130 concentrically and rotatably disposed around sun gear 129 defining an annular clearance therebetween, a circular carrier plate 131 secured to the tubular portion of spacer 110 and three planetary gears 132 held by carrier plate 131 and meshed with both sun gear 129 and ring gear 130. A metal bush 133 is press-fitted in a bore of sun gear 129 and rotatably disposed on the tubular portion of spacer 110. As shown, metal bush 133 is formed with a flange.

With the above-mentioned arrangement, planetary gear unit 128 operates in the following manner.

When ring gear 130 is free and planetary gears 32 are revolved together with carrier plate 131 without inducting rotation of planetary gears 32, ring gear 130 and sun gear 129 are rotated together with carrier plate 131 at the same speed like a single unit. When under this condition only ring gear 130 is applied with a braking force, ring gear 130 is forced to rotate in a retarded direction relative to carrier plate 131 causing rotation of planetary gears 132. With this, rotation speed of sun gear 129 is increased and thus circular guide plate 123 is rotated in an advanced direction relative to drive plate 103.

As is understood from FIG. 7, first and second electromagnetic brakes 126 and 127 are annular in shape and have substantially the same construction. First electromagnetic brake 126 is concentrically disposed around second electromagnetic brake 127. An annular first brake plate 134 is secured to a peripheral portion of circular guide plate 123 and arranged to face first electromagnetic brake 126, and an annular second brake plate 135 is integrally connected to ring gear 130 and arranged to face second electromagnetic brake 127.

Both first and second electromagnetic brakes 126 and 127 are tightly and concentrically held by VTC cover 112. Thus, when these brakes 126 and 127 are electrically energized, first and second brake plates 134 and 135 are magnetically attracted or braked by them.

When braked by first and second electromagnetic brakes 126 and 127, circular guide plate 123 is forced to rotate in a normal or reversed direction (advanced or retarded direction) relative to spacer 110. This relative rotation between circular guide plate 123 and spacer 110 is restricted between predetermined two angular positions by a stopper device 140.

As is seen from FIG. 9, stopper device 140 comprises generally a second structure 141 provided on a rear peripheral portion of circular guide plate 123 and a first structure 142 provided on a front peripheral portion of drive plate 103. That is, when circular guide plate 123 and drive plate 103 make a relative rotation in one or the other direction by a certain degree, second and first structures 141 and 142 are brought into contact with each other thereby stopping or restricting the relative rotation. Second structure 141 is a projected member provided on the rear surface of circular guide plate 123. First structure 142 comprises a rectangular base member 143 provided on the front surface of drive plate 103 and a rectangular elastic member 144 disposed around rectangular base member 143. For connecting rectangular base member 143 and elastic member 144 to drive plate 103, a retainer 146 and a bolt 145 are used, as shown. That is, retainer 146 has a raised tongue part, and retainer 146 is secured to drive plate 103 by bolt 145 having the holding tongue part pressed against elastic member 144. Upon assembly of first structure 142, longitudinal ends of the rectangular elastic member 144 face a circumferential direction that is perpendicular to a radial direction of drive plate 103. As will become apparent hereinafter, under operation, second structure 141 is brought into contact with one of the two longitudinal ends of elastic member 144 for suppressing further relative rotation between circular guide plate 123 and drive plate 103. Due to the rectangular shape of base member 143, undesired rotation of elastic member 144 about base member 143 is suppressed.

In the following, operation valve timing control device 200 of the second embodiment will be described.

At engine starting or under engine idling, first electromagnetic brake 126 is de-enegized and second electromagnetic brake 127 is energized, and thus, only second brake plate 135 is braked. With this, a braking force is applied to ring gear 130 of planetary gear unit 128, and thus, in accordance with turning of drive plate 103, circular guide plate 123 is rotated in a speed increased side, and thus, as is seen from FIG. 8, cylindrical portions 117 of link arms 114 are left at radially outer sides of respective guide grooves 108 of drive plate 103. Accordingly, spacer 110 (and thus cam shaft 101), to which link arms 114 are pivotally connected through pin support portions 109, is caused to assume the most-retarded side relative to drive plate 103. Thus, rotation phase of the crankshaft of the associated engine is controlled to the most-retarded side improving engine rotation stability and fuel consumption.

When now the engine is shifted to a normal operation condition from the above-mentioned starting or idling condition, first electromagnetic brake 126 is energized and second electromagnetic brake 127 is de-energized thereby applying a braking force to only first brake plate 134 to brake the same. With this, ring gear 30 becomes free and circular guide plate 123 is applied with a braking force, so that circular guide plate 123 is rotated in a speed reduced side relative to drive plate 103. As a result, balls 119 held by the leading end portions (viz., cylindrical portions 117) of respective link arms 114 are forced to move radially inward in spiral guide groove 124 as is seen from FIGS. 11 and 12 and at the same time, cylindrical portions 117 are moved radially inward in respective guide grooves 108 while tuning about respective axes. That is, during this, as is seen from FIGS. 11 and 12, each link arm 114 is gradually inclined changing the relative angle between drive plate 103 and spacer 110 (or cam shaft 101) toward the most-advanced angular side. Cam shaft 101 is thus turned in an advanced direction inducing high power operation of the engine.

The relative angle between drive plate 103 and spacer 110 (or cam shaft 101) is controlled in the above-mentioned manner. When the relative angle shows the most-retarded or most-advanced degree, second structure 141 on circular guide plate 123 and first structure 142 on drive plate 103 come into contact with each other as is seen from FIGS. 8 and 12. Thus, excessive relative rotation between drive plate 103 and cam shaft 101 is suppressed.

During operation of the engine, varying torque originating from profile of drive cams and biasing force of valve springs is applied to cam shaft 101. In the valve timing control device 200 of this second embodiment, second and first structures 141 and 142 are arranged to directly stop or restrict the relative rotation between circular guide plate 123 and drive plate 103. Accordingly, even when, with second and first structures 141 and 142 kept in contact with each other, the above-mentioned varying torque is applied to cam shaft 101, undesired thrash operation never occurs on the contacting surfaces between second and first structures 141 and 142. That is, between cam shaft 101 and circular guide plate 123, there is transmitted a torque through the operation portions of link arms 114 and an engaging portion between each ball 119 and spiral guide groove 124. Thus, the varying torque applied from cam shaft 101 to spacer 110 is sufficiently damped by the frictional engagement that would take place at the operation portions of link arms 114 and the engaging portion between each ball 119 and spiral guide groove 124. Thus, the contacting surfaces between second and first structures 141 and 142 are not effected by the varying torque.

Furthermore, in this second embodiment 200, first structure 142 of stopper device 140 is constructed to have elastic member 144 that serves as a shock absorber. Thus, collision between second and first structures 141 and 142 is softly made, which achieves a noiseless operation of valve timing control device 200 of the invention.

Due to the nature of spiral guide groove 124, circular guide plate 123 can rotate about 360 degrees relative to drive plate 103. This allows second and first structures 141 and 142 to stop a relative rotation between circular guide plate 123 and drive plate 103 in both positive and negative directions at given angles. That is, stopper device 140 employed in this second embodiment 200 is simple and thus low in cost. If second structure 141 is integrally formed on circular guide plate 123, much simple and low cost construction is achieved by stopper device 140.

If desired, the following modifications may be applied to the above-mentioned second embodiment 200.

Figure 13:
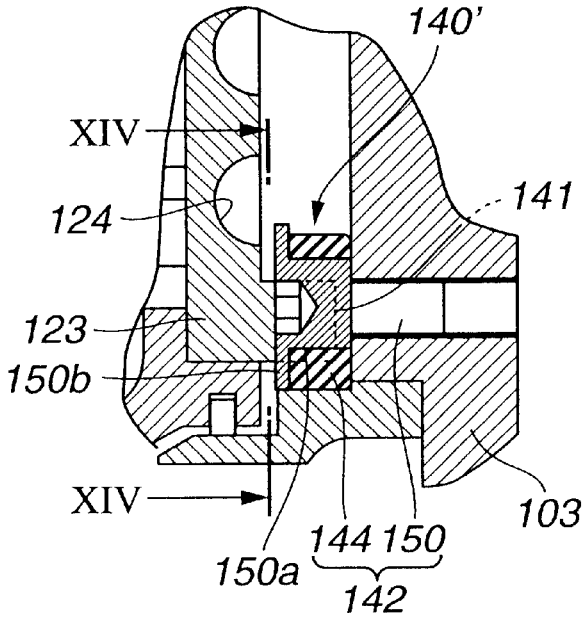
FIG. 13 is an enlarged sectional view of a modified stopper device of the valve timing control device of the second embodiment of the present invention.
Figure 14:
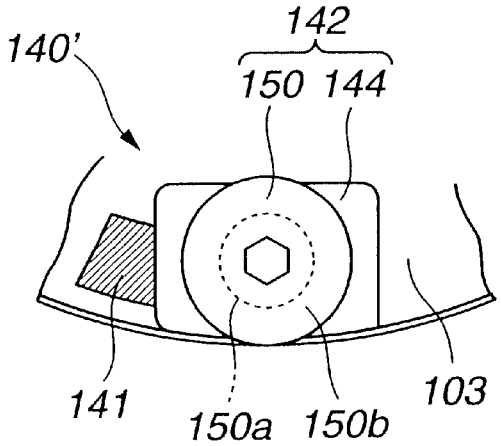
FIG. 14 is a sectional view taken along the line XIV—XIV of FIG. 13.

FIGS. 13 and 14 show another stopper device 140' employed in place of the above-mentioned stopper device 140. In this stopper device 140', rectangular elastic member 144 is connected to drive plate 103 by only a connecting bolt 150. For this connection, connecting bolt 150 has a flanged head comprising a cylindrical base portion **150*a* on which elastic member 144 is disposed and an annular flange portion 150*b* by which elastic member 144 is pressed against the front surface of drive plate 103. That is, elastic member 144 and connecting bolt 150 constitute a first structure 142 of stopper device 140'. In this modification 140', the number of parts used is reduced as compared with the above-mentioned stopper device 140**.

The entire contents of Japanese Patent Applications 2001-319908 filed Oct. 17, 2001 and 2001-315062 filed Oct. 12, 2001 are incorporated herein by reference.

Although the invention has been described above with reference to the embodiments of the invention, the invention is not limited to such embodiments as described above. Various modifications and variations of such embodiments may be carried out by those skilled in the art, in light of the above description.

What is claimed is:

1. A valve timing control device of an internal combustion engine, comprising:

a drive rotation member adapted to be rotated by an output shaft of the engine;

a driven rotation member coaxial with said drive rotation member, said driven rotation member rotating with a cam shaft of the engine to actuate engine operation valves;

a relative angle controlling mechanism that controls a relative angle between said drive and driven rotation members; and an actuating device that actuates said relative angle controlling mechanism, said actuating device having a planetary gear unit which comprises a sun gear, a ring gear, a carrier plate and planetary gears rotatably held by the carrier plate and meshed with both said sun gear and said ring gear, said sun gear, said ring gear and said carrier plate serving as one of input, output and free elements, said input element being connectable to and driven by a rotation system that extends from said output shaft of the engine to said cam shaft of the engine, said output element being connectable to a rotation actuation element of said relative angle controlling mechanism in a manner to be controlled in rotation speed upon receiving an input force from said output shaft of the engine; and a first stopper device arranged between said output element and said drive rotation member, said first stopper device stopping a relative rotation therebetween when the relative rotation angle therebetween comes to a first predetermined degree.

2. A valve timing control device as claimed in claim 1, further comprising a second stopper device arranged between said free element and said input element, said second stopper device stopping a relative rotation therebetween when the relative rotation angle therebetween comes to a second predetermined degree.

3. A valve timing control device as claimed in claim 1, in which said relative angle control mechanism comprises:

radially extending guide grooves formed in one surface of said drive rotation member;

a circular guide plate arranged to rotate relative to said drive and driven rotation members, said circular guide plate being formed with a spiral guide groove at one surface thereof that faces said radially extending guide grooves;

guided members each being slidably guided by both said spiral guide groove and one of said radially extending guide grooves; and link arms each having one end pivotally connected to said driven rotation member and the other end to which corresponding one of said guided members is connected.

4. A valve timing control device of an internal combustion engine, comprising:

a drive rotation member adapted to be rotated by an output shaft of the engine;

a driven rotation member coaxial with said drive rotation member, said driven rotation member rotating with a cam shaft of the engine to actuate engine operation valves;

a relative angle controlling mechanism that controls a relative angle between said drive and driven rotation members; and an actuating device that actuates said relative angle controlling mechanism, said actuating device having a planetary gear unit which comprises a sun gear, a ring gear, a carrier plate and planetary gears rotatably held by the carrier plate and meshed with both said sun gear and said ring gear, said sun gear, said ring gear and said carrier plate serving as one of input, output and free elements, said input element being connectable to and driven by a rotation system that extends from said output shaft of the engine to said cam shaft of the engine, said output element being connectable to a rotation actuation element of said relative angle controlling mechanism in a manner to be controlled in rotation speed upon receiving an input force from said output shaft of the engine;

a first stopper device arranged between said output element and said drive rotation member, said first stopper device stopping a relative rotation therebetween when the relative rotation angle therebetween comes to a first predetermined degree, and a second stopper device arranged between said free element and said input element, said second stopper device stopping a relative rotation therebetween when the relative rotation angle therebetween comes to a second predetermined degree.

5. A valve timing control device as claimed in claim 4, in which said carrier plate constitutes said input element, one of said sun gear and said ring gear constitutes said output element and the other of said sun gear and said ring gear constitutes said free element.

6. A valve timing control device as claimed in claim 5, further comprising:

a first braking device that applies a braking force to said output element; and a second braking device that applies a braking force to said free element.

7. A valve timing control device as claimed in claim 4, in which said first stopper device comprises:

a first member that is provided by said drive rotation member; and a second member that is provided by said output element, wherein said first and second members contact with each other to stop the relative rotation between said output element and said drive rotation member when the relative rotation angle therebetween comes to said first predetermined degree.

8. A valve timing control device as claimed in claim 7, in which said second stopper device comprises:

a third member that is provided by said free element; and a fourth element that is provided by said input element, wherein said third and fourth members contact with each other to stop the relative rotation between said free element and said input element when the relative rotation angle therebetween comes to said second predetermined degree.

9. A valve timing control device as claimed in claim 7, in which at least one of said first and second members is constructed of a shock absorbing material for absorbing a shock produced when said first and second members contact with each other.

10. A valve timing control device as claimed in claim 8, in which at least one of said third and fourth members is constructed of a shock absorbing member for absorbing a shock produced when said third and fourth members contact with each other.

11. A valve timing control device of an internal combustion engine, comprising:

a drive rotation member adapted to be rotated by an output shaft of the engine;

a driven rotation member coaxial with said drive rotation member, said driven rotation member rotating with a cam shaft of the engine to actuate engine operation valves;

radially extending guide grooves formed in one surface of said drive rotation member;

a circular guide plate arranged to rotate relative to said drive and driven rotation members, said circular guide plate being formed with a spiral guide groove at one surface thereof that faces said radially extending guide grooves;

guided members each being slidably guided by both said spiral guide groove and one of said radially extending guide grooves;

link arms each having one end pivotally connected to said driven rotation member and the other end to which corresponding one of said guided members is connected;

an actuating device that actuates said circular guide plate to rotate relative to said drive and driven rotation members;

a stopper device that restricts a rotation of said circular guide plate relative to said drive and driven rotation members, wherein when, upon operation of said actuating device, said circular guide plate is rotated relative to said drive and driven operation members, each of said guide members is forced to slide in both said spiral guide groove and the corresponding one of the radially extending guide grooves to induce a relative rotation between said drive and driven rotation members; and wherein said stopper device comprises a first member that is provided by said circular guide plate and a second member that is provided said drive rotation member, said first and second members contacting with each other to stop the relative rotation between said drive rotation member and said circular guide plate when a relative rotation angle therebetween comes to a predetermined degree.

12. A valve timing control device as claimed in claim 11, in which at least one of the first and second members is constructed of a shock absorbing material for absorbing a shock produced when said first and second members contact with each other.

13. A valve timing control device as claimed in claim 11, in which said first and second members are projected members provided on said circular guide plate and said drive rotation member respectively.

14. A valve timing control device as claimed in claim 11, in which at least one of the first and second members is a projected portion that is integrally formed on the corresponding one of the circular guide plate and said drive rotation member.

15. A valve timing control device as claimed in claim 11, in which said second member comprises:

a base member provided on the surface of said drive rotation member;

a rectangular elastic member disposed around said base member;

a retainer secured to said drive rotation member, said retainer having a raised tongue part pressed against said rectangular elastic member, and in which said first member is a projected portion provided on said circular guide plate.

16. A valve timing control device as claimed in claim 15, in which said rectangular elastic member of said second member has exposed opposed ends to which said first member is contactable.

17. A valve timing control device as claimed in claim 15, in which said base member has a rectangular cross section to suppress an easy rotation of said rectangular elastic member thereabout.

18. A valve timing control device as claimed in claim 11, in which said second member comprises a rectangular elastic member secured to said drive rotation member by means of a connecting bolt, said rectangular elastic member having exposed opposed ends to which said first member is contactable.

19. A valve timing control device as claimed in claim 18, in which said connecting bolt has a flanged head which comprises a cylindrical base portion on which said elastic member is disposed and an annular flange portion by which said elastic member is pressed against the surface of said drive rotation member.

20. A valve timing control device of an internal combustion engine, comprising:

a drive rotation member adapted to be rotated by an output means of the engine;

a driven rotation member coaxial with said drive rotation member, said driven rotation member rotating with a cam shaft of the engine to actuate engine operation valves;

a relative angle controlling mechanism that controls a relative angle between said drive and driven rotation members; and an actuating device that actuates said relative angle controlling mechanism, said actuating device having a planetary gear unit which comprises a sun gear, a ring gear, a carrier plate and planetary gears rotatably held by the carrier plate and meshed with both said sun gear and said ring gear, said sun gear, said ring gear and said carrier plate serving as one of input, output and free elements, said input element being connectable to and driven by a rotation system that extends from said output shaft of the engine to said cam shaft of the engine, said output element being connectable to a rotation actuation element of said relative angle controlling mechanism in a manner to be controlled in rotation speed upon receiving an input force from said output shaft of the engine; and first stopper means arranged between said output element and said drive rotation member, said first stopper means stopping a relative rotation therebetween when the relative rotation angle therebetween comes to a first predetermined degree.

* * * * *